US008474642B2

(12) United States Patent
Chen

(10) Patent No.: US 8,474,642 B2
(45) Date of Patent: Jul. 2, 2013

(54) DIAPER DISPOSAL CONTAINER

(75) Inventor: Jung Tsai Chen, Tainan (TW)

(73) Assignee: Baby Trend Inc., Ontario, CA (US)

( * ) Notice: Subject to any disclaimer, the term of this patent is extended or adjusted under 35 U.S.C. 154(b) by 600 days.

(21) Appl. No.: 12/507,061

(22) Filed: Jul. 21, 2009

(65) Prior Publication Data

US 2010/0187235 A1 Jul. 29, 2010

Related U.S. Application Data

(60) Provisional application No. 61/082,818, filed on Jul. 22, 2008.

(51) Int. Cl.
*B65D 43/14* (2006.01)

(52) U.S. Cl.
USPC ..... 220/252; 220/908; 220/254.3; 220/253

(58) Field of Classification Search
USPC ..... 220/495.06, 254.8, 318, 253, 495.07, 220/252, 254.3, 262, 908, 908.1, 908.3
See application file for complete search history.

(56) References Cited

U.S. PATENT DOCUMENTS

| | | | | | |
|---|---|---|---|---|---|
| 1,333,051 | A * | 3/1920 | Young | 220/252 |
| 1,638,360 | A * | 8/1927 | Olson | 220/252 |
| 3,322,477 | A * | 5/1967 | Armijo | 312/211 |
| 3,452,368 | A * | 7/1969 | Couper | 4/484 |
| 3,536,192 | A * | 10/1970 | Couper | 206/303 |
| 4,828,107 | A * | 5/1989 | Spencer | 206/366 |
| 4,934,529 | A * | 6/1990 | Richards et al. | 206/303 |
| 5,046,614 | A * | 9/1991 | Torres et al. | 206/366 |
| 5,154,345 | A * | 10/1992 | Shillington | 232/44 |
| 5,183,157 | A * | 2/1993 | Darden | 206/390 |
| 5,651,231 | A * | 7/1997 | Garland | 53/258 |
| 5,765,339 | A * | 6/1998 | Garland | 53/258 |
| 5,957,319 | A * | 9/1999 | Shane da Costa | 220/495.06 |
| D431,888 | S | 10/2000 | Roudebush | |
| 6,364,147 | B1 * | 4/2002 | Meinzinger et al. | 220/495.06 |
| 6,612,099 | B2 * | 9/2003 | Stravitz | 53/526 |
| 7,100,767 | B2 * | 9/2006 | Chomik et al. | 206/409 |
| 7,114,314 | B2 * | 10/2006 | Stravitz | 53/567 |
| 7,146,785 | B2 * | 12/2006 | Stravitz | 53/567 |
| 7,316,100 | B2 * | 1/2008 | Stravitz et al. | 53/211 |
| 7,395,646 | B2 * | 7/2008 | Salman et al. | 53/567 |
| 7,516,844 | B2 * | 4/2009 | Erickson et al. | 206/366 |
| 7,617,659 | B2 * | 11/2009 | Stravitz et al. | 53/567 |
| 7,696,711 | B2 * | 4/2010 | Pollack et al. | 318/466 |
| 7,757,467 | B2 * | 7/2010 | Chomik et al. | 53/567 |
| 8,127,519 | B2 * | 3/2012 | Stravitz | 53/469 |
| 2007/0125792 | A1 * | 6/2007 | Pollack et al. | 220/908.2 |
| 2007/0246465 | A1 * | 10/2007 | Stravitz et al. | 220/200 |

* cited by examiner

*Primary Examiner* — Anthony Stashick
*Assistant Examiner* — Christopher McKinley
(74) *Attorney, Agent, or Firm* — Chen Yoshimura LLP

(57) ABSTRACT

A disposal container having a container body, a seal section disposed on top of the container body and having an opening with a seal band around the opening, a transfer barrel pivotally mounted on the seal section, the transfer barrel having a substantially spherical outer surface with an opening on the outer surface, and a handle pivotally mounted on the seal section. The handle and the transfer barrel are mounted to rotate coaxially in synchronization. When the handle and the transfer barrel are rotated to an open position, the opening of the transfer barrel is above the seal band; when they are rotated to a closed position, the opening of the transfer barrel is below the seal band. In another embodiment, a lid rather than a handle is provided and coupled to the transfer barrel to rotate it. Springs are provided to urge the lid toward an open position.

4 Claims, 9 Drawing Sheets

DIAPER DISPOSAL CONTAINER

This application claims priority from U.S. Provisional Patent Application No. 61/082,818, filed Jul. 22, 2008, which is herein incorporated by reference in its entirety.

BACKGROUND OF THE INVENTION

1. Field of the Invention

This invention relates to a disposal container for soiled items such as diapers.

2. Description of the Related Art

Many designs of waste disposal containers for soiled items, such as diapers, have been described. Some examples include disposal containers described in U.S. Pat. App. Pub. Nos. 2007/0246465 and 2007/0125792, U.S. Pat. Nos. 5,651,231, 5,765,339, 7,316,100, 7,146,785, 6,612,099, 7,114,314 and D431888.

SUMMARY OF THE INVENTION

The present invention is directed to a disposal container that substantially obviates one or more of the problems due to limitations and disadvantages of the related art.

An object of the present invention is to provide an improved sealed cover and disposing channel for a disposal container.

Another object of the present invention is to provide a disposal bag dispenser and bag cartridge for use in a disposal container.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a disposal container which includes: a container body for containing items being disposed of; a seal section disposed on top of the container body, the seal section having an opening in communication with an interior of the container body with a seal band around the opening; a transfer barrel pivotally mounted on the seal section, the transfer barrel having a substantially spherical outer surface situated in the opening of the seal section in contact with the seal band, the transfer barrel defining a hollow inside space with an opening on the outer surface; and a handle pivotally mounted on the seal section, wherein the handle and the transfer barrel are mounted on the seal section to rotate coaxially in synchronization, and wherein when the handle and the transfer barrel are rotated to an open position, the opening of the transfer barrel is above the seal band and when the handle and the transfer barrel are rotated to a closed position, the opening of the transfer barrel is below the seal band.

In another aspect, the present invention provides a disposal container which includes: a container body for containing items being disposed of; a seal section disposed on top of the container body, the seal section having an opening in communication with an interior of the container body with a seal band around the opening; a transfer barrel pivotally mounted on the seal section, the transfer barrel having a substantially spherical outer surface situated in the opening of the seal section in contact with the seal band, the transfer barrel defining a hollow inside space with an opening on the outer surface, wherein when the transfer barrel is rotated to an open position, the opening of the transfer barrel is above the seal band and when the transfer barrel is rotated to a closed position, the opening of the transfer barrel is below the seal band; and a lid disposed over the transfer barrel, the lid being moveably mounted on the seal section and moveable between an open position and a closed position, wherein the lid and the transfer barrel are mechanically coupled to each other such that they move between their respective open positions and their respective closed positions in synchronization; and one or more springs coupled to the lid for urging the lid toward its open position.

In another aspect, the present invention provides a disposal container which includes: a container body for containing items being disposed of; a seal section disposed on top of the container body, the seal section having an opening in communication with an interior of the container body with a seal band around the opening; a transfer barrel pivotally mounted on the seal section, the transfer barrel having a substantially spherical outer surface situated in the opening of the seal section in contact with the seal band; and a bag dispenser disposed inside the container body below the seal section for retaining a bag cartridge carrying a tubing material.

It is to be understood that both the foregoing general description and the following detailed description are exemplary and explanatory and are intended to provide further explanation of the invention as claimed.

BRIEF DESCRIPTION OF THE DRAWINGS

FIGS. 1*a*-3 illustrate a disposal container according to a first embodiment of the invention.

DETAILED DESCRIPTION OF THE PREFERRED EMBODIMENTS

Figures 1A, 1B:
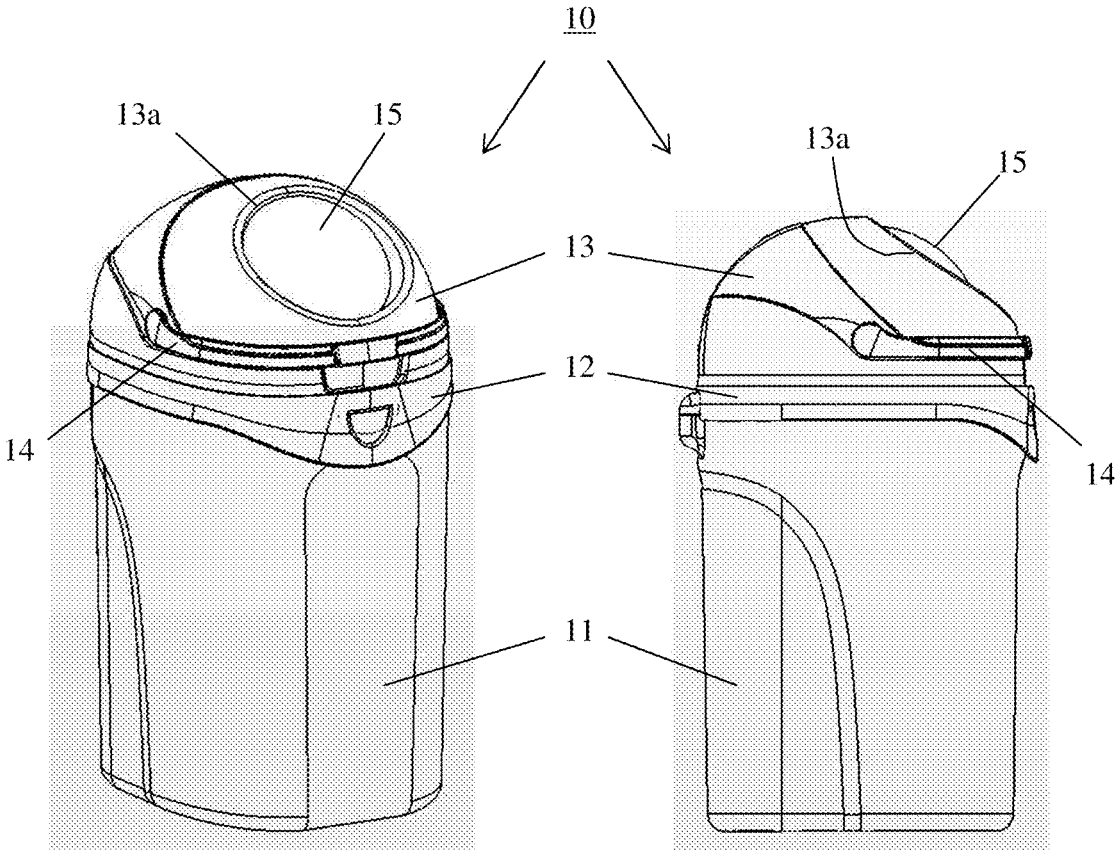

FIGS. 1*a* and 1*b* are front perspective and side views of the disposal container 10 in the closed state. The disposal container 10 has a container body 11 for receiving the soiled items, a seal section 12 disposed on top of the container body, a top cover 13 disposed on top of the seal section, a handle 14, and a transfer barrel 15. The top cover 13 covers the transfer barrel 15, and has an opening 13*a* through which the barrel is partially exposed.

Figure 2:
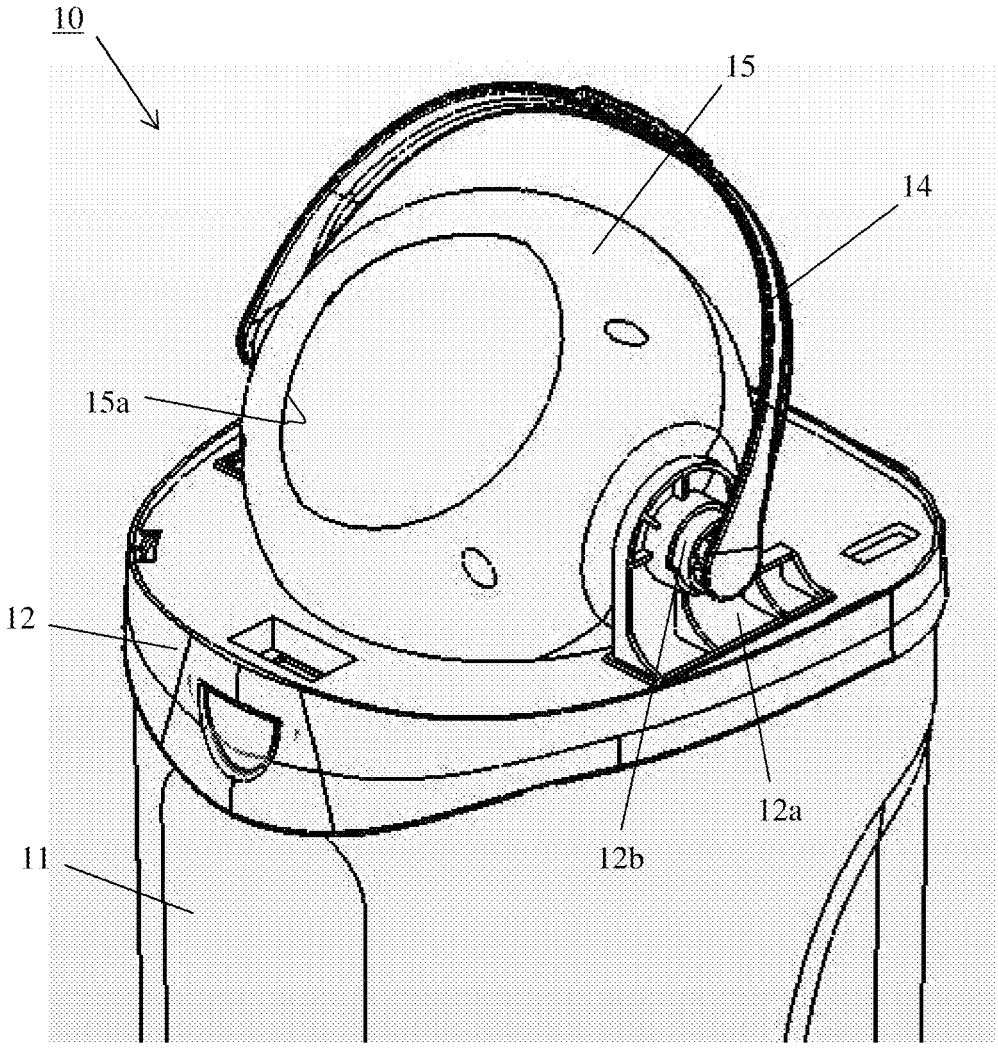
Figure 3:
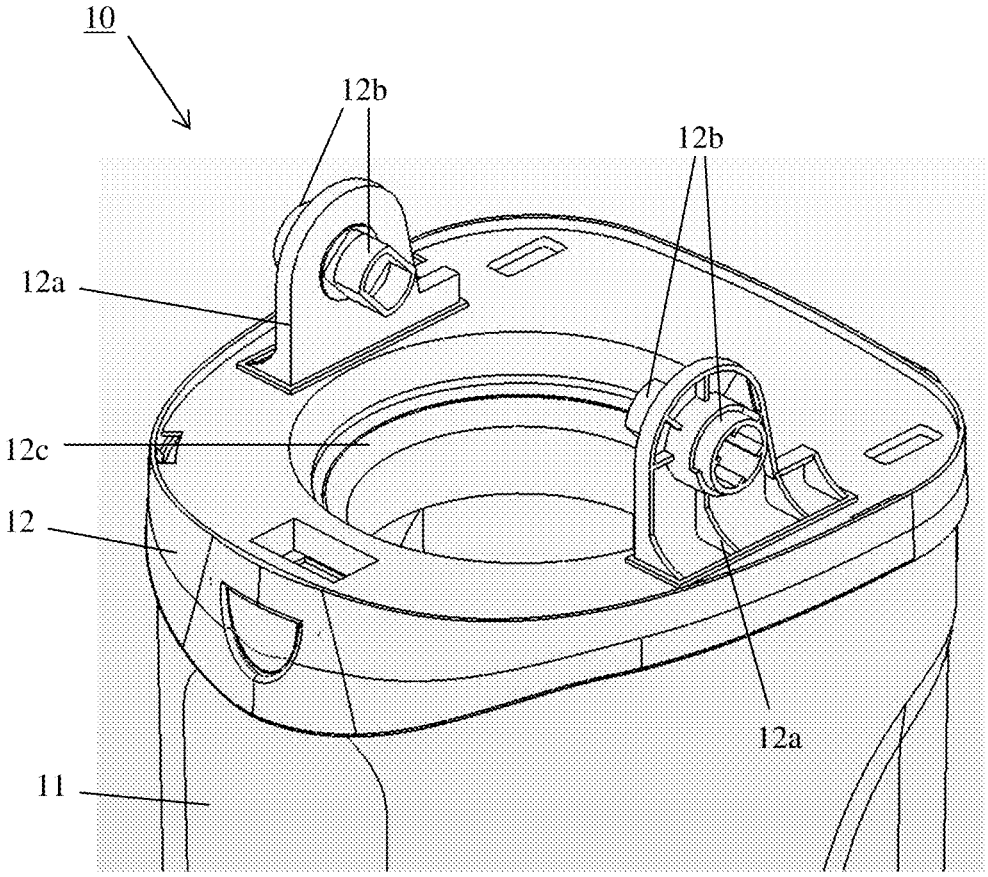

FIG. 2 is a perspective view of the top portion of the disposal container 10 in the open state, with the top cover 13 removed to show the transfer barrel 15. FIG. 3 is a perspective view of the top portion of the disposal container 10 with the top cover 13, the transfer barrel 15 and the handle 14 removed to show the interior of the seal section 12. As shown in FIGS. 2 and 3, the barrel 15 and the handle 14 are pivotally mounted on the seal section 12 by two mounting brackets 12*a* and two rotating shafts 12*b* which pass through the brackets. The barrel 15 and the handle 14 are fitted over or into the rotating shaft 12*b* in a locking manner (e.g., by providing a non-circular cross-sectional shape for the shaft as shown in FIG. 3, or by fixing the barrel and the handle to the rotating shaft), so that the barrel and the handle rotate coaxially in synchronization. Alternatively, the rotating shafts may be designed so that they are an integral part of the barrel 15 or an integral part of the handle 14. Alternatively, instead of two mounting brackets 12*a* and two rotating shafts 12*b*, other mechanical designs may be employed so long as the mounting structure allows the barrel 15 and the handle 14 to rotate coaxially in synchronization.

As shown in FIG. 2, the barrel 15 is generally spherical in shape and has a hollow space at its center with an opening 15*a* to the surface of the sphere. The barrel 15 is oriented such that when the handle 14 is in a closed position (which is a substantially horizontal position in this embodiment as shown in FIGS. 1*a* and 1*b*), the opening 15*a* faces downwards. When the handle 14 is in an open position (which is a substantially vertical or past vertical position in this embodiment as shown in FIG. 2), the barrel 15 is rotated such that the opening 15*a* faces upward and is exposed through the opening 13*a* of the top cover 13.

As shown in FIGS. 2 and 3, the seal section 12 has an opening in communication with the interior of the container body 11 with a seal band 12*c* around the opening. The barrel 15 is situated in the opening of the seal section and is in contact with the seal band. Preferably, the shape of the inner surface of seal band 12*c* is a part of a sphere matching the shape of the barrel 15. When the handle 14 is in the closed position, the opening 15*a* on the barrel 15 is located below the seal band 12*c* and exposed to the interior of the container body 11, so that the content of the hollow space of the barrow can fall into the container body. In one embodiment, the seal band 12*c* has a width greater than the size of the opening 15*a* of the barrel 15, so that the hollow space of the barrel is not simultaneously open to both the interior of the container and the opening 13*a* of the top cover.

In use, the handle 14 is normally in the closed position as shown in FIGS. 1*a* and 1*b*. To dispose of an item, the handle 14 is rotated to the open position, and the barrel 15 rotates with the handle to expose the opening 15*a* of the barrel through the opening 13*a* of the top cover (see FIG. 2). The item is disposed in the hollow space of the barrel, and the handle 14 is rotated back to the closed position. In this position, the item in the hollow space of the barrel falls into the interior of the container. The seal band 12*c*, by virtual of its contact with the barrel 15, prevents odor from escaping from the interior of the container. The transfer barrel functions to transfer the item into the interior of the container without exposing the interior to the outside in that process.

Figure 4:
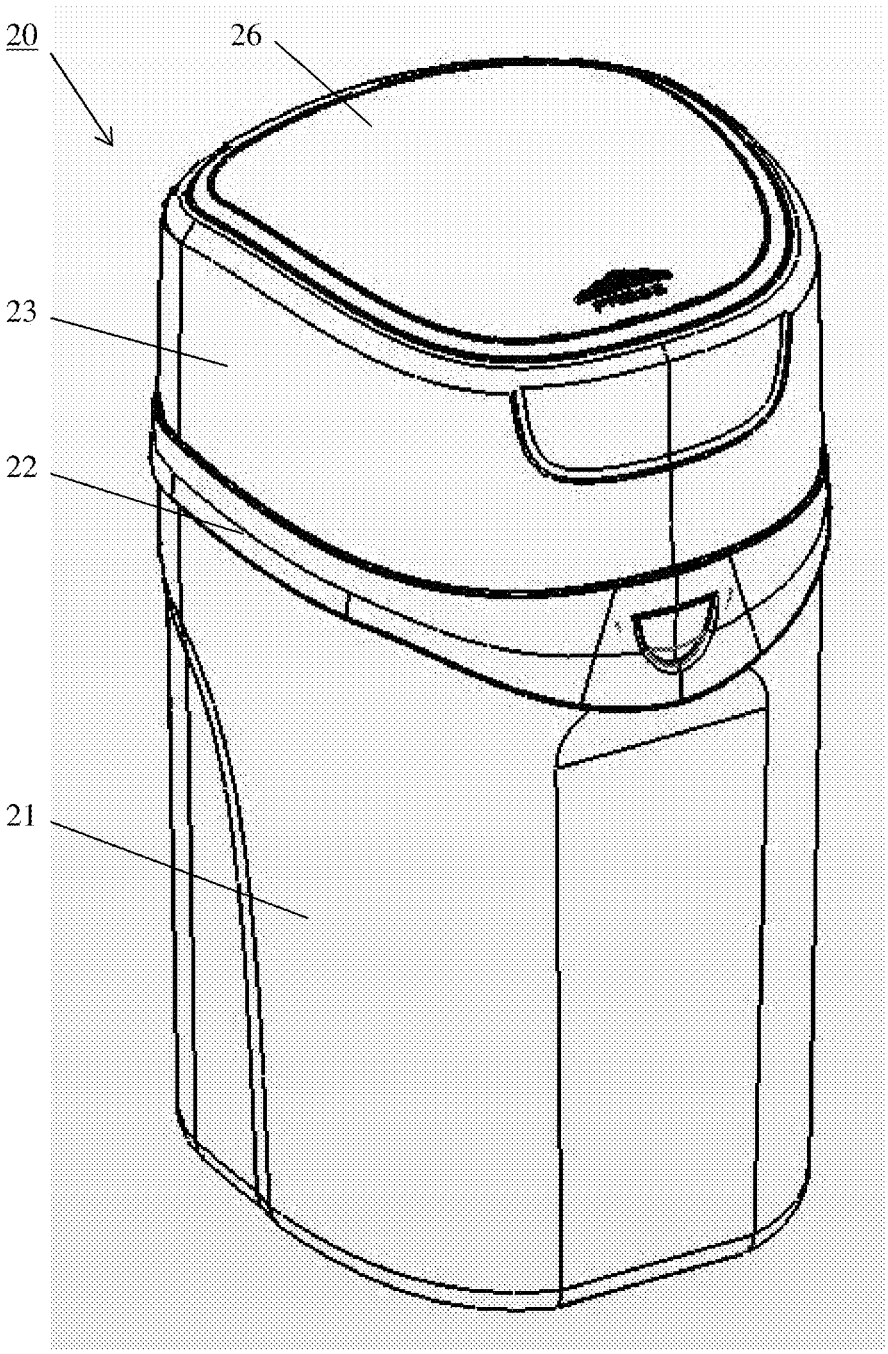
FIGS. 4-6 illustrate a disposal container according to a second embodiment of the invention.
Figure 5:
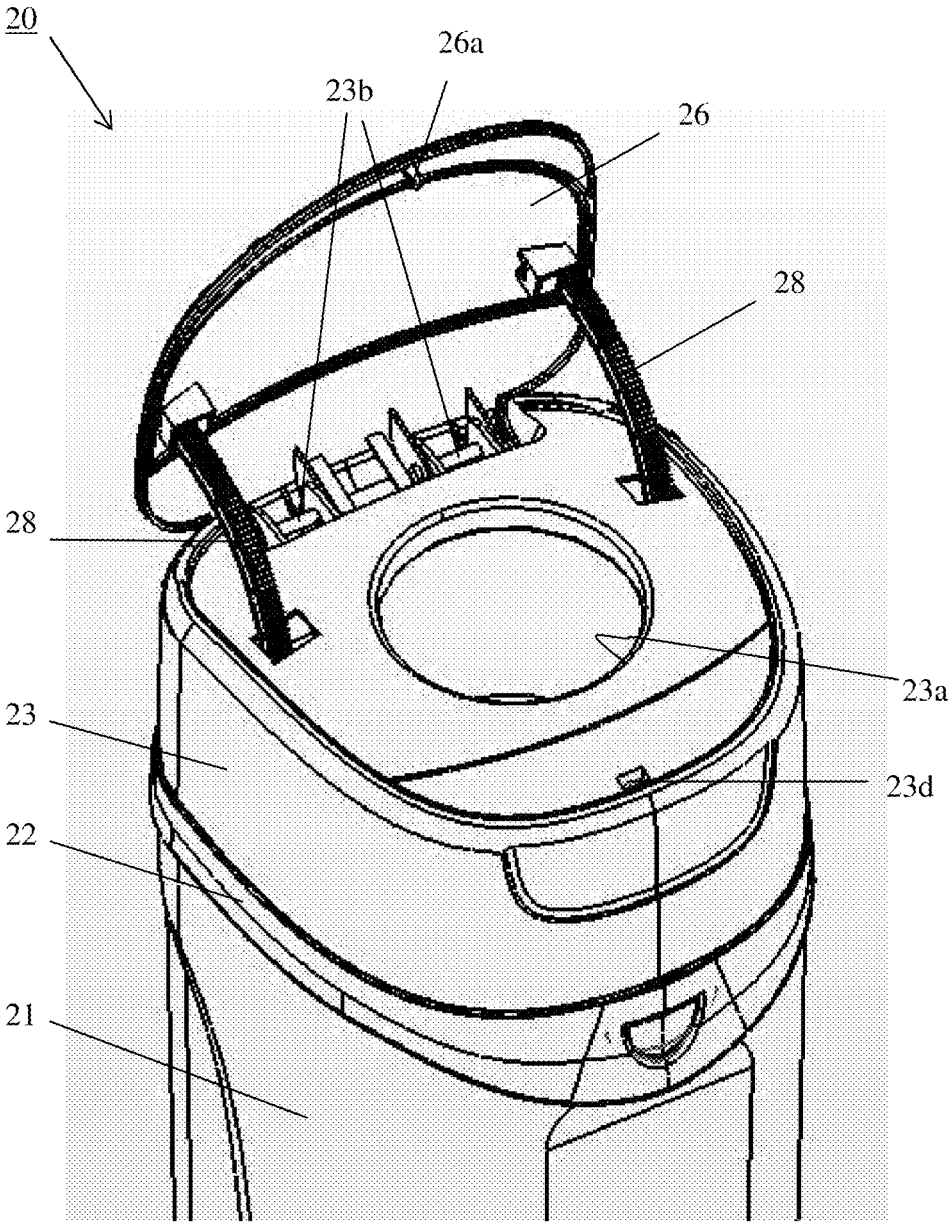
Figure 6:
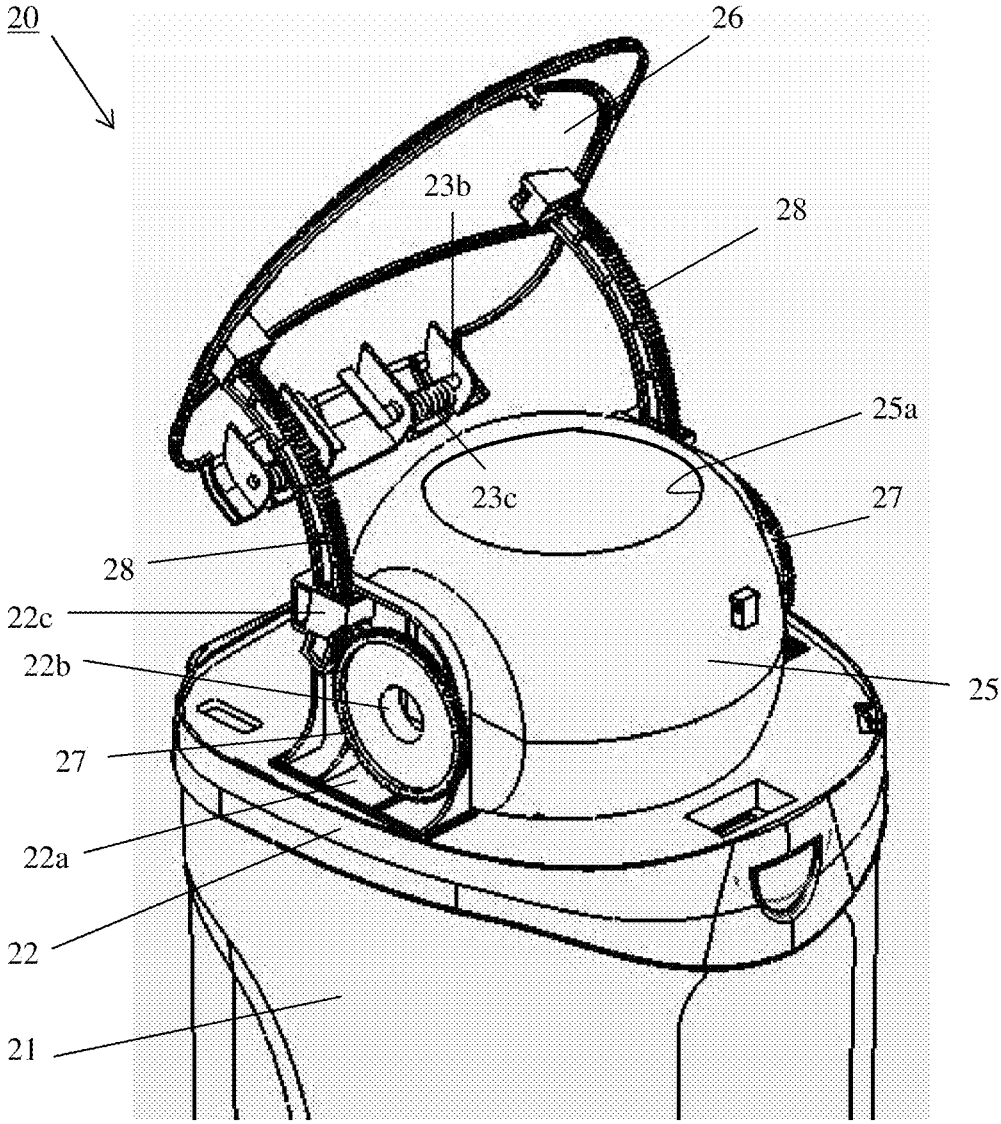

FIGS. 4-6 illustrate a disposal container 20 according to a second embodiment of the present invention. FIG. 4 is a front perspective view of the disposal container 20 in the closed state. FIG. 5 is a perspective view of the top portion of the disposal container 20 in the open state. FIG. 6 is a perspective view of the top portion of the disposal container 20 in the open state, where the top cover 23 is not shown.

As shown these figures, the disposal container 20 has a container body 21 for receiving the soiled items, a seal section 22 disposed on top of the container body, a top cover 23 disposed on top of the seal section, a lid 26, and a transfer barrel 25. The top cover 23 covers the transfer barrel 25, and has an opening 23*a* through which the barrel is partially exposed.

As shown in FIG. 5, the lid 26 is pivotally mounted on the top cover 23 around a rotation shaft 23*b* located near the rear of the cover. One or more compression springs 23*c* (see FIG. 6; not shown in FIG. 5) are disposed around the shaft 23*b* and pressed against the lid 26 and the top cover 23. When the lid 26 is in the closed position (FIG. 4), the springs are compressed and urge the lid toward the open position (FIG. 5). The springs 23*c* shown in FIG. 6 are coil springs that store energy by being twisted. Other types of springs may be used, such as coil springs that store energy by being compressed or extended axially, flat springs (plates), etc. Any suitable structures may be used to store energy generated when the lid is moved from the open to closed position where the energy can be released to open the lid. The lid 26 is normally held in the closed position by a latch 26*a*/23*d*. The latch may have any suitable structure, and has a release mechanism. In one embodiment, the lid is pressed down once to engage the latch, and pressed again to release the latch.

As shown in FIG. 6, the barrel 25 is pivotally mounted on the seal section 22 by two mounting brackets 22*a* and two rotating shafts 22*b* which pass through the brackets. Two gearwheels 27 are also mounted on the rotating shafts 22*b* and rotate in synchronization with the barrel 25. Two arc shaped gears 28 which mesh with the gearwheels 27 are fixed on the under side of the lid 26 at one end. Each gear 28 passes through a guide 22*c* on the seal portion 22. In the illustrated embodiment, the guides 22*c* are formed integrally with the mounting brackets 22*a*. When the lid 26 opens and closes, the gears 28 move with the lid along arcuate lines while sliding through the guides 22*c*, driving the gearwheels 27 to rotate. The barrel 25 rotates with the gearwheels 27. The teeth of the gears 27 and 28 are designed such that when the arc shaped gear 28 moves with the lid 26 between the closed state and the open state (which is approximately a quarter circle in the illustrated embodiment), the gearwheels 27 rotate by approximately one half of a circle. While gear wheels 27 and gears 28 are shown in this embodiment, other suitable force transfer structure may be used to mechanically couple the opening and closing movement (rotation or linear movement) of the lid 26 to the rotation of the barrel 25. For example, more gear wheels or gear may be used, or a belt or lever may be used as a part of the force transfer structure, etc.

The barrel 25 is generally spherical in shape and has a hollow space at its center with an opening 25*a* to the surface of the sphere. The barrel 25 is oriented such that when the lid 26 is in the closed position, the opening 25*a* faces downwards toward the interior of the container 21. When the lid is rotated to the open position, the barrel 25 is rotated so that the opening 25*a* faces upward (see FIG. 6) and is exposed through the opening 23*a* of the top cover 23 (see FIG. 5).

Similar to the first embodiment, the seal section 23 has an opening in which the barrel 25 is situated, and a seal band in contact with the barrel to provide a seal.

In use, the lid 26 is normally in the closed position as shown in FIG. 4. To dispose of an item, the latch that holds the lid closed is released, and the lid is urged by the compression springs 23*c* to open. As the lid opens, the gears 27, 28 transmits the motion into the rotation of the barrel 25, so that the opening 25*a* of the barrel is rotated upwards and exposed through the opening 23*a* of the top cover (see FIGS. 5 and 6). The item is disposed in the hollow space of the barrel, and the lid 26 is pressed down (while compressing the springs 23*c*) to the closed position and is held by the latch. As the lid closes, the barrel 25 rotates so that the opening 25*a* faces downwards and the item falls into the interior of the container body 21.

While the barrel 15/25 has a substantially spherical shape in the embodiments illustrated above, other shapes may also be used, so long as parts of the barrel have rotational symmetry such that the surface of the barrel is in contact with the seal band of the seal section when the handle 14 or lid 26 is in the open position, the closed position and positions in between to maintain the seal.

Figure 7:
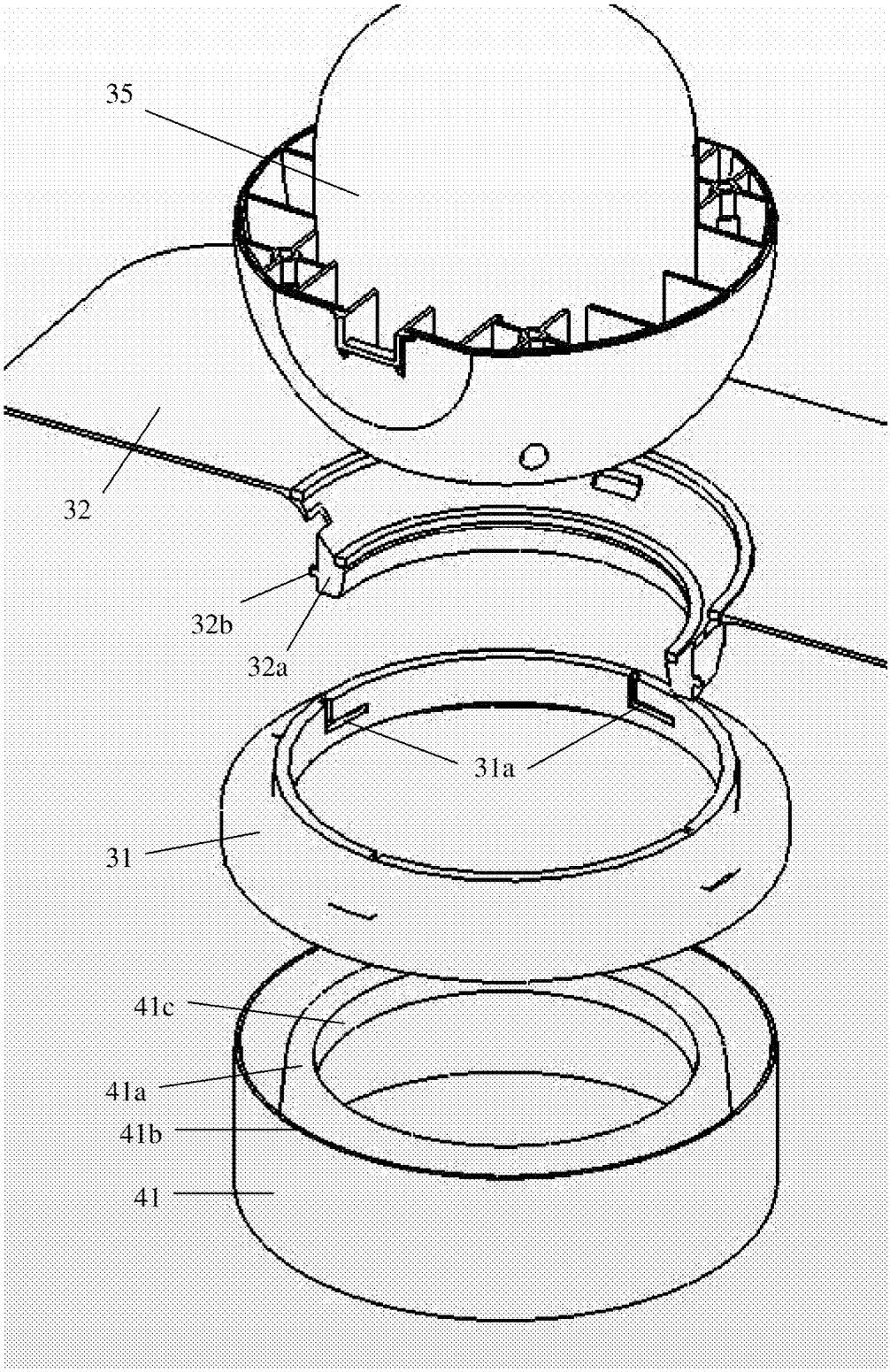
FIG. 7 illustrates structures for installing disposal bags in a disposal container according to another embodiment of the present invention.
Figure 8A:
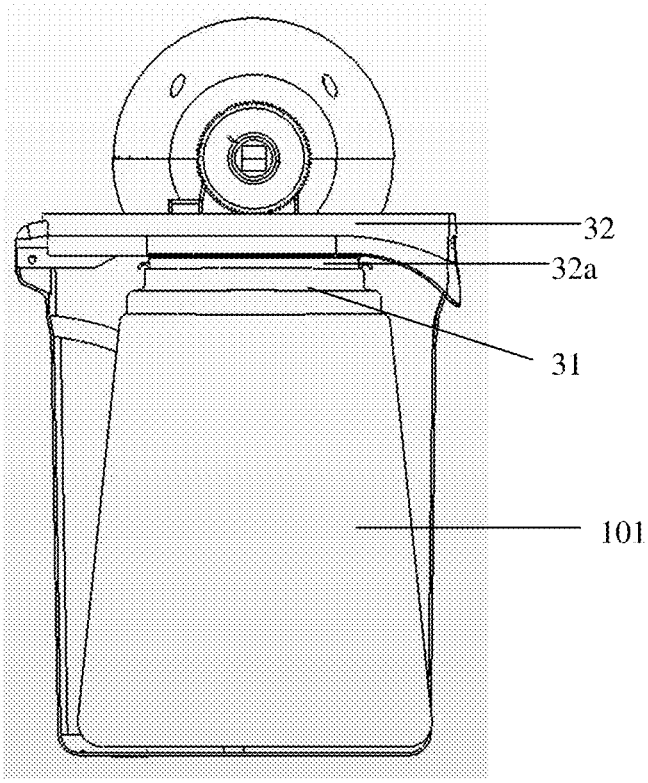
FIGS. 8*a* and 8*b* illustrates two examples of disposal bags installed in the disposal container in the embodiment of FIG. 7.

The interior of the container 10/20 may be lined with a plastic bag, such as a garbage bag or bags from a bag cartridge/dispenser specially made for the container. The bag retaining structures described below can be used with both the first and second embodiments. It can also be suitably used with other disposal containers. Referring to FIG. 7, a bag retainer ring 31 is provided to retain the top edge of the bag when an individual bag (e.g. a 13 gallon garbage bag) is used. The seal section 32 (which may correspond to the seal sections 12 and 22 in the first and second embodiments) has a flange 32*a* around the center opening of the seal section. The retainer ring 31 is disposed around the flange 32*a* when installed. The retainer ring has a number of L-shaped grooves 31*a* on the inside, which correspond to a number of short pins 32*b* on the outside of the flange 32*a* of the seal section 32. To install an individual bag (not shown in FIG. 7), the seal portion 32 is opened (it is connected to the container body by hinges), the retainer ring 31 is dismounted, and the top (the open end) of the bag is pulled through the inside of the retainer ring 31 and folded outwardly over the top rim of the retainer ring. The retainer ring 31 is then aligned with the seal section 32 so that the pins 32*b* are aligned with the vertical portions of the L-shaped grooves 31*a*. The retainer ring (with the top rim of the bag) is pushed towards the seal section until the pins 32*b* reach the bottom of the grooves 31*a*, and the retainer ring is rotated slightly so that the pins 32*b* slides in the horizontal portions of the L-shaped grooves. This locks the retainer ring 31 to the seal section 32, securing the bag to the seal section. Preferably, the seal section 12 is secured so the container body 11 by a latch, and a seal is provided between the seal section and the container body to prevent odor from escaping from the container. FIG. 8*a* illustrates the container with a regular garbage bag 101 installed using the retainer ring 31.

Figure 8B:
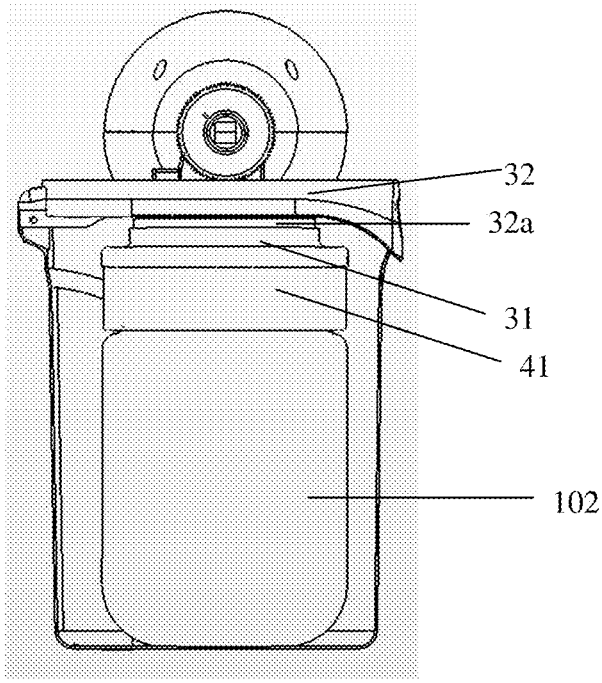

To use a bag cartridge/dispenser, the retainer ring 31 is attached to the seal section 32 (without a garbage bag), and a bag dispenser 41 with a bag cartridge disposed inside is mounted onto the underside of the retainer ring 31. Pins and L-shaped grooves may be user to mount the dispenser 41 on the retainer ring 31, similar to how the retainer 31 is mounted on the seal section 32. FIG. 8*b* illustrates the container with a bag 102 installed using the bag dispenser 41 and the retainer ring 31. Alternatively, the dispenser 41 may be designed to mount directly on the seal section 32.

Figure 9A:
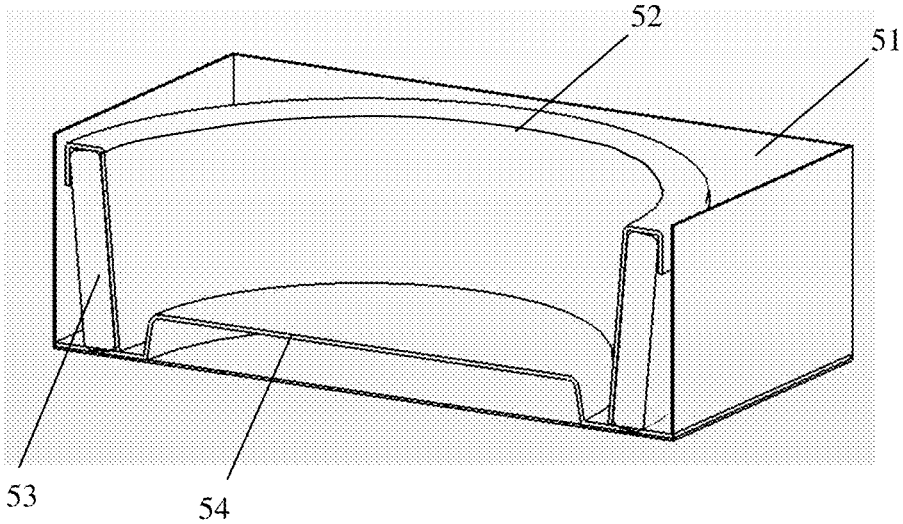
FIGS. 9*a* and 9*b* illustrate a disposal bag cartridge and its use according to another embodiment of the present invention.
Figure 9B:
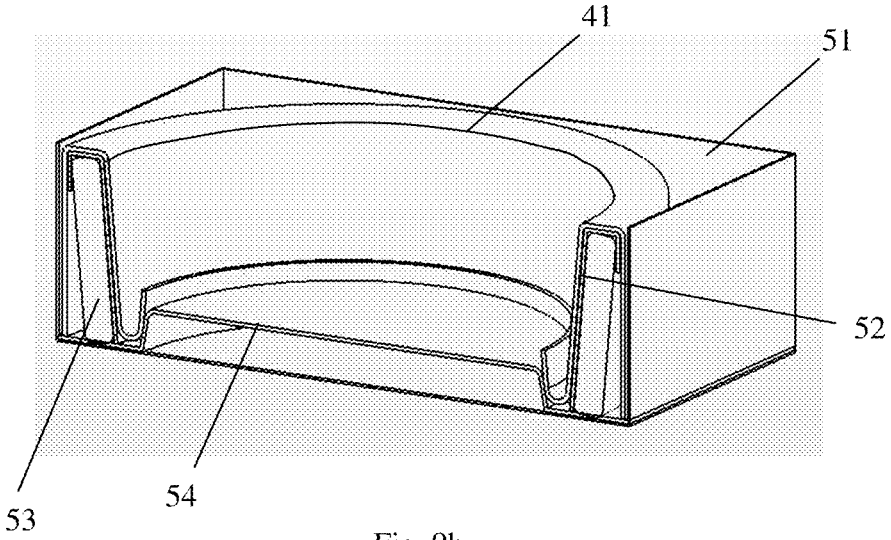

FIGS. 9*a* and 9*b* illustrate the bag cartridge and the dispenser 41 in more detail. FIG. 9*a* is a partial cutaway view of a bag cartridge, which is a consumable item. The bag cartridge is delivered to the user in a packaging box 51. The cartridge has a core 52 having a cylindrical shape (preferably a tapered cylindrical shape), and a pleated plastic tubing 53 packed around the core. As shown in FIG. 7, the bag dispenser 41 (a re-use, non-consumable item) has a cylindrical shape (preferably tapered) with two concentric (preferably tapered) cylindrical walls 41*a* and 41*b*, and the annular space between the two walls is designed to accommodate the core 52 with the packed plastic tubing 53. The two walls are joined by a ring-shaped piece at the bottom of the dispenser, leaving the top of the annular space open ("top" and "bottom" are with respect to the orientation of the dispenser as shown in FIG. 7). To install the bag cartridge, after the user opens the bag cartridge box 51, he turns the bag dispenser 41 over and pushes it over the core 52 and the packed plastic tubing 53 as shown in FIG. 9*b*. A guide member 54 may be disposed inside the box 51 to help center the dispenser 41 over the core 52. The user then turns the box 51 over, removes the box and the guide member 54, so that the bag cartridge core 52 and bags 53 are loaded in the dispenser 41, with the dispenser now in the upright orientation as shown in FIG. 7. The dispenser 41 is mounted on the retainer ring 31 as described earlier.

The inner wall 41*a* of the dispenser 41 is slightly lower than the outer wall 41*b* to form a gap above the inner wall from which the bag passes through. The top of the inner wall folds inwardly and downwardly to form a smooth lip 41*c* for the bag to hang from. After the bag cartridge is installed (i.e. the dispenser 41 is mounted on the retainer ring 31 with the bag cartridge inside), a length of the plastic tubing 53 is pulled from the underside through the inside space of the dispenser 41, and a knot is tied at the distal end of the tubing to form a bag. The seal section 32 with the retainer ring 31 and the dispenser 41 are then placed over the container body 21 for normal use of the container 10 (the knot is located at the bottom of the container 10 during such use). To change bags, the seal section 32, along with the retainer ring 31 and dispenser 41 mounted thereon, is opened. Some tubing material may be pulled from the cartridge in the opening process. The plastic tubing is cut above the filled portion, and another length of the tubing may be pulled and knotted to form a new bag. The dispenser 41 does not need to be removed from the retainer ring 31 to change bags.

It will be apparent to those skilled in the art that various modification and variations can be made in the disposal container and the disposal bag installation structures of the present invention without departing from the spirit or scope of the invention. Thus, it is intended that the present invention cover modifications and variations that come within the scope of the appended claims and their equivalents.

What is claimed is:

1. A disposal container comprising:

a container body for containing items being disposed of;

a seal section disposed on top of the container body, the seal section having an opening in communication with an interior of the container body with a seal band around the opening;

a transfer barrel pivotally mounted on the seal section, the transfer barrel having a substantially spherical outer surface situated in the opening of the seal section in contact with the seal band, the transfer barrel defining a hollow inside space with an opening on the outer surface; and a handle pivotally mounted on the seal section, wherein the handle and the transfer barrel are mounted on the seal section to rotate coaxially in synchronization, wherein the seal section includes two mounting brackets and two rotating shafts each passing through one of the mounting brackets, and wherein both the transfer barrel and the handle engage the rotating shafts in a locking manner, wherein a shape of an inner surface of the seal band is a part of a sphere matching the spherical outer surface of the transfer barrel, and wherein when the handle and the transfer barrel are rotated to an open position, the opening of the transfer barrel is above the seal band and when the handle and the transfer barrel are rotated to a closed position, the opening of the transfer barrel is below the seal band, the seal band having a width greater than a size of the opening of the transfer barrel to prevent the hollow inside space of the transfer barrel from being simultaneously open to both above and below the seal band.

2. The disposal container of claim 1, further comprising a top cover disposed on top of the seal section over the transfer barrel, the top cover defining an opening through which the opening of the transfer barrel is exposed when the transfer barrel and the handle are rotated to the open position.

3. The disposal container of claim 1, further comprising a bag dispenser disposed inside the container body below the seal section, the bag dispenser having concentric inner and outer walls forming an annular space for retaining a bag cartridge, wherein a top rim of the inner wall is spaced from the seal section by a gap to allow a bag to pass though from the bag cartridge to the interior of the container body.

4. The disposal container of claim 3, wherein the bag dispenser is removeably mounted on the seal section.

* * * * *